United States Patent [19]

Durbin et al.

[11] Patent Number: 4,700,623

[45] Date of Patent: Oct. 20, 1987

[54] AIRCRAFT TRASH COMPACTOR

[75] Inventors: James L. Durbin, Valencia; Robert M. Clemens, Newhall, both of Calif.

[73] Assignee: A.K.G.S. Partnership, A Partnership of Las Vegas, Las Vegas, Nev.

[21] Appl. No.: 781,391

[22] Filed: Sep. 26, 1985

[51] Int. Cl.[4] ..... B30B 15/16

[52] U.S. Cl. ..... 100/52; 100/100; 100/218; 100/229 A; 100/269 R; 91/166; 92/53

[58] Field of Search ..... 100/100, 229 A, 269 R, 100/52, 218; 92/53; 91/165–169

[56] References Cited

U.S. PATENT DOCUMENTS 3,853,052 12/1974 Engebretsen ..... 100/229 A
4,119,028 10/1978 Khan ..... 100/229 A X
4,130,054 12/1978 Tashman ..... 100/52
4,188,872 2/1980 Chrablow ..... 100/52 X

*Primary Examiner*—Harvey C. Hornsby
*Attorney, Agent, or Firm*—Fulwider, Patton, Rieber, Lee & Utecht

[57] ABSTRACT

This invention is directed to a trash compactor suitable for use in aircraft and aerospace vehicles. The compactor includes improved hydraulic power and control systems which provide short compaction cycle times and high compaction ratios and which has integrated means to loosen trash containers from the supporting walls of the compacting chamber at the completion of the compaction cycle so that the filled trash containers can be readily removed from the compactor.

19 Claims, 18 Drawing Figures

AIRCRAFT TRASH COMPACTOR

BACKGROUND OF THE INVENTION

This invention generally relates to trash compactors and particularly to trash compactors for aircraft or aerospace vehicles.

The handling of large amounts of waste material generated during the flight of passenger-carrying aircraft has long presented a major problem to in-flight service personnel. The introduction of wide-bodied jet aircraft with very high density passenger configurations has exacerbated the problem, not only from an in-flight service point of view but also with respect to flight safety. Current methods of waste disposal on board passenger-carrying aircraft include the use of paperboard boxes and plastic bags in conjunction with trash bins or trash carts which require high volume storage areas. Frequently when the primary trash storage areas are filled, plastic bags or paper bags with plastic inserts are used to collect excess trash. These excess trash containers are frequently stored during the flight in the galley areas or in lavatories, thereby rendering them unusable for passengers, and even behind the last row of passenger seats or in unused passenger seats. Such filled trash containers are not only unsightly, but they also present a serious risk of on-board fire due to the highly combustible nature of the trash and the possibility that ignition sources may have been introduced into the container along with the trash. An additional safety hazard is created when excess filled trash containers are stored in exit areas because these containers may block or impede egress in emergency situations.

During a typical five-hour flight with statistically average passenger loads on wide-bodied aircraft (e.g., from Hawaii to California or across the continental United States), approximately 20 to 30 cubic feet of trash may be generated. On longer transoceanic routes lasting up to 15 hours, 80 to 120 cubic feet of trash may be generated due to the number of meal, snack and bar services that are offered.

The trash compactors now available for residential uses are incapable of handling the large volumes of trash generated on board an aircraft within the time constraints for in-flight service. They have neither the power, the space saving capability nor the cycle time sufficient to meet the in-flight service requirements.

If trash compactors are to be used on aircraft, they would either have to be placed within the galley of the aircraft, or in an easily accessible processing location such as, a closet, or have to be fitted onto rolling carts of the same or similar size as the food and beverage trolleys used on the aircraft. Thus, such compactors would have to be relatively small, lightweight and be custom configuring to fit in the many appropriate installation locations aboard aircraft and space vehicles. Commercial or industrial trash compactors now available are much too large and heavy for such uses, and they require electrical power not ordinarily available on the aircraft.

Moreover, none of the trash compactors now available can meet the U.S. Federal Aviation Administration requirements for in-flight use.

Thus, there has been a long felt need for trash compactors which will meet the spacial and human engineering requirements for use in aircraft and spacecraft and will be capable of meeting the stringent FAA and or NASA requirements for such use. The present invention satisfies this need.

SUMMARY OF THE INVENTION

This invention is directed to an improved trash compactor which is particularly suitable for aircraft and aerospace applications. The trash compactor is small, lightweight, and powerful enough to provide relatively short cycle times for trash compaction. Moreover, the trash containers filled with compacted trash can be readily removed from the compactor of the invention with very little manual effort.

The trash compactor in accordance with the present invention generally includes a housing or cabinet, a compacting chamber within the housing which has walls and flooring adapted to support disposable, self-supporting trash containers placed therein, a means to load trash into such trash containers placed in the compacting chamber and power and control systems for compacting trash placed in the container.

The compacting system of the invention comprises an extendible ram drive means fixed at one end thereof to the upper portion of the housing interior and provided with a compacting ram or platen at the other end thereof. The system, preferably hydraulically-actuated, is operated to drive the compacting ram downwardly against trash placed in the container. To handle the large volumes of trash with short cycle times and to provide the degree of trash compacting required for aircraft use, the extendible ram drive means is designed to apply a force to the compacting ram which ensures that the ram applies a maximum compacting pressure of at least 15 psi, preferably at least 30 psi, onto the trash. As used herein, the expression "compacting pressure" refers to the total force applied to the compacting ram divided by the area defined by the outline of the ram face which contacts the trash. When the ram has developed compacting pressure on the trash which exceeds a predetermined maximum compacting pressure of at least 15 psi, or preferably more than 30 psi, the control system for the compactor causes the extension of the ram drive assembly to terminate and then causes the ram drive assembly to retract and thereby withdraw the ram from the trash container. If the power source is not capable of developing the desired compacting pressure the trash volume reductions are, for the most part, inadequate for aircraft use.

When trash is compacted at pressures of the magnitude described above, significantly higher levels of pressure are transferred through the compacted trash to the sides of the disposable trash container so that a frictional engagement or adhesion is developed between the trash container and the walls of the compacting chamber which is considerably more tenacious than that obtained with conventional compactors which operate at considerably lower compacting pressures, particularly when large volumes of liquid, characteristic of in-flight generated trash, are in the trash container. To facilitate removal of disposable containers filled with compacted trash from the compacting chamber, means actuated by the retraction of the ram are provided to develope relative movement between the disposable trash container and the chamber walls to release the frictional engagement or adhesion so that the container filled with compacted trash can be easily removed by hand from the compacting chamber without damaging the container.

The present trash compactor for use on board aircraft is made of strong, lightweight materials such as titanium alloys and graphite composites, yet it has sufficient compaction power to provide a rapid cycling time with large volumes of trash. The ratio of the total force capable of being applied to the compacting ram to the tare weight of the compactor is at least 40 to 1, preferably at least 60 to 1.

At the start of the compacting operation of the invention, the ram drive assembly is retracted with the ram in an up or ready position. Trash is dropped through a chute in the front of the housing into a disposable, self-supporting trash container located in the compacting chamber. When there is a sufficient amount of trash in the container, the compactor unit is actuated by starting a hydraulic pump. By means of a unique control valve system, the high pressure hydraulic fluid from the pump is directed to the ram drive assembly to extend the drive and thereby urge the ram connected thereto against the trash in the trash container. When the high pressure hydraulic fluid provides a compacting pressure which exceeds a predetermined maximum limit greater than 15 psi, the control valve system redirects high pressure hydraulic fluid from the pump to the retraction system of the ram drive assembly, so that the assembly is retracted and the ram is lifted from the trash container. As the ram is retracted into an up position, it trips a switch which shuts off the electrical power to the motor which drives the hydraulic fluid pump and thereby terminates the flow of high pressure fluid to the assembly. An uplock valve is provided in the control valve system to hold ram in the up position until the compactor is again actuated.

In one preferred embodiment of the invention, one or more of the compacting chamber walls are hydraulically actuated to move with respect to the trash container to relieve the adhesion therebetween so that the disposable trash container filled with compacted trash can be readily removed from the compacting chamber.

In another preferred embodiment of the invention, the walls of the compacting chamber are sloped inwardly in the downward direction and the floor is provided with an inflatable bladder which, when inflated, urges the filled trash container upwardly thereby relieving the frictional engagement between the container and chamber walls.

In both of the above embodiments the preferred hydraulic power source is the same hydraulic power source which operates the ram drive assembly.

The disposable, self-supporting trash container used with the compactor of the invention is preferably the cardboard or paperboard trash container described and claimed in the copending application Ser. No. 635,141, filed on July 27, 1984, which is assigned to the present assignee.

These and other advantages of the invention will become more apparent from the following detailed description of the invention when taken in conjunction with the following exemplary drawings.

DETAILED DESCRIPTION OF THE DRAWINGS

Figure 1:
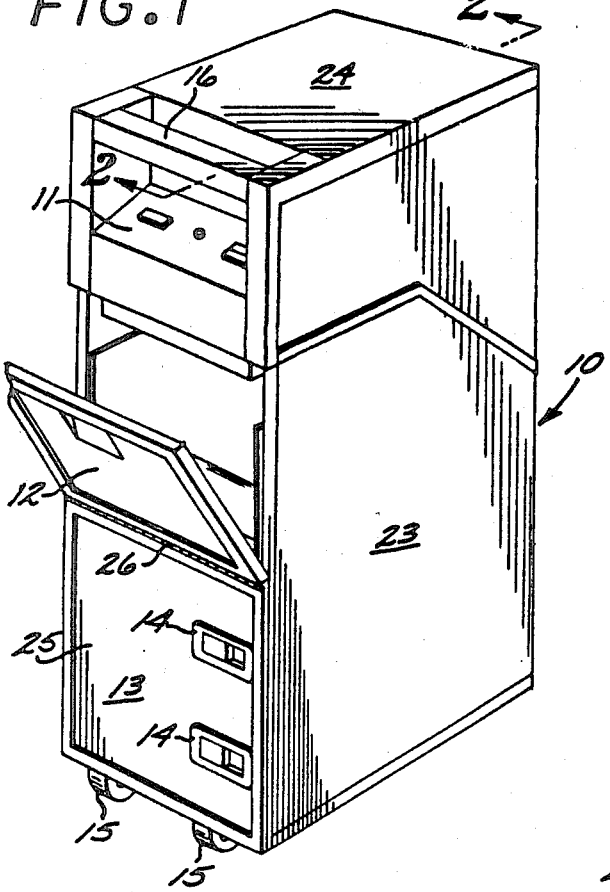
FIG. 1 is a perspective view of a trash compactor embodying features of the invention.
Figure 3:
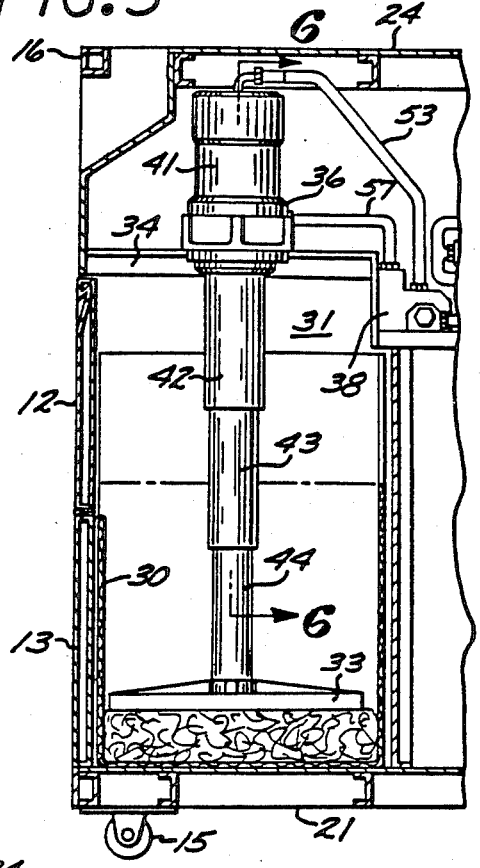
FIG. 3 is a partial view as shown in FIG. 2, but with the ram drive assembly in an extended position.

Reference is made to FIG. 1 which is a perspective view of a trash compactor embodying features of the invention. As shown in this figure, the compactor generally comprises a housing or cabinet 10 which has a control panel 11, a chute 12 for feeding trash into the interior of the housing 10, and a door 13 in the front of the housing 10 for inserting and removing trash containers. The door 13 is provided with latches 14 for the opening and closing thereof. The particular embodiment shown in FIG. 1 is designed to be portable and is provided with wheels 15 on the lower portion thereof and with a handle 16 to facilitate moving the compactor.

FIGS. 2–5 generally illustrate the interior of the compactor shown in FIG. 1. As shown, the compactor housing 10 generally includes a rigid frame 20 and has a bottom panel 21, a rear panel 22, side panels 23, an upper panel 24, and a front panel 25. The cabinet 10 is provided with the chute 12 which is pivotally connected to the front panel 25 of the housing 10 by means of a hinge 26 for feeding trash into a trash container 30 positioned in compacting chamber 31 within the interior of the housing 10. Door 13 is pivotally mounted along one side thereof by means of the hinges 27 (see FIG. 4) in order to install and remove trash containers 30. Preferably, suitable electrical interlocks (not shown) are provided on the chute 12 and the door 13 to ensure that the compactor is inoperable unless both are closed.

The operational elements of the compactor generally comprise a compacting ram drive assembly 32, having a ram 33 fixed to the one end thereof, which is supported at the other end thereof from the cross member 34 of interior frame 20 in the upper portion of the compactor interior. The ram drive assembly 32 is operated by high pressure hydraulic fluid from pump 35 which is driven by electrical motor 36. The pump 35 and motor 36 are supported by cross members 37 of the frame 20. Control valve system 38 directs the hydraulic fluid to the ram drive assembly 32 and other portions of the compactor to control the operation thereof.

Figure 2:
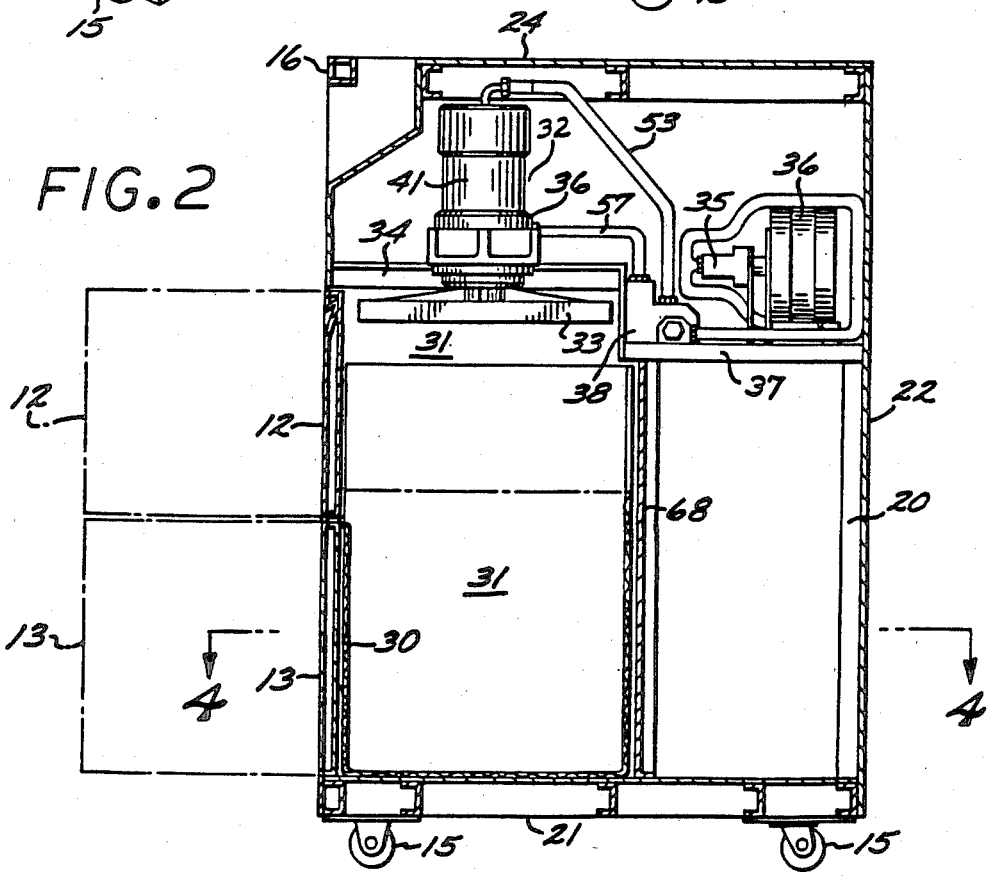
FIG. 2 is a cross-sectional view taken along the lines 2—2 in FIG. 1 showing the compacting ram in an up or start position.
Figure 6:
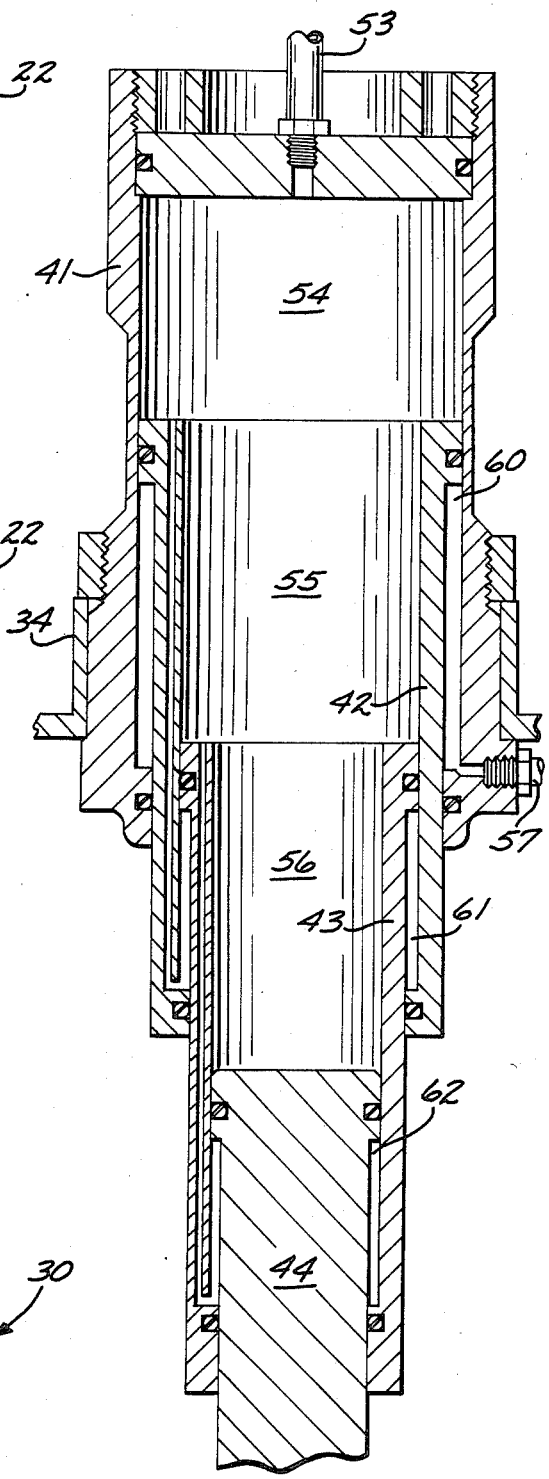
FIG. 6 is a sectional view of the ram drive assembly taken along the lines 6—6 shown in FIG. 3.
Figure 13:
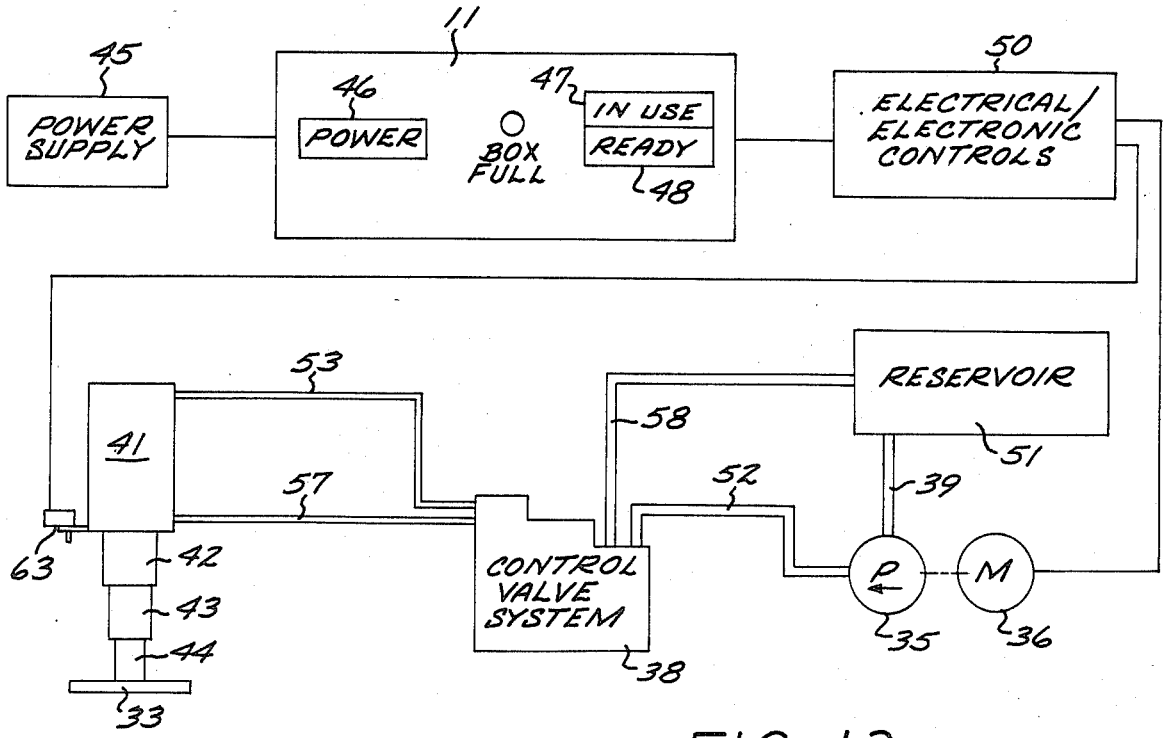
FIG. 13 is a schematic view of the control system for operating the compactor.
Figure 14:
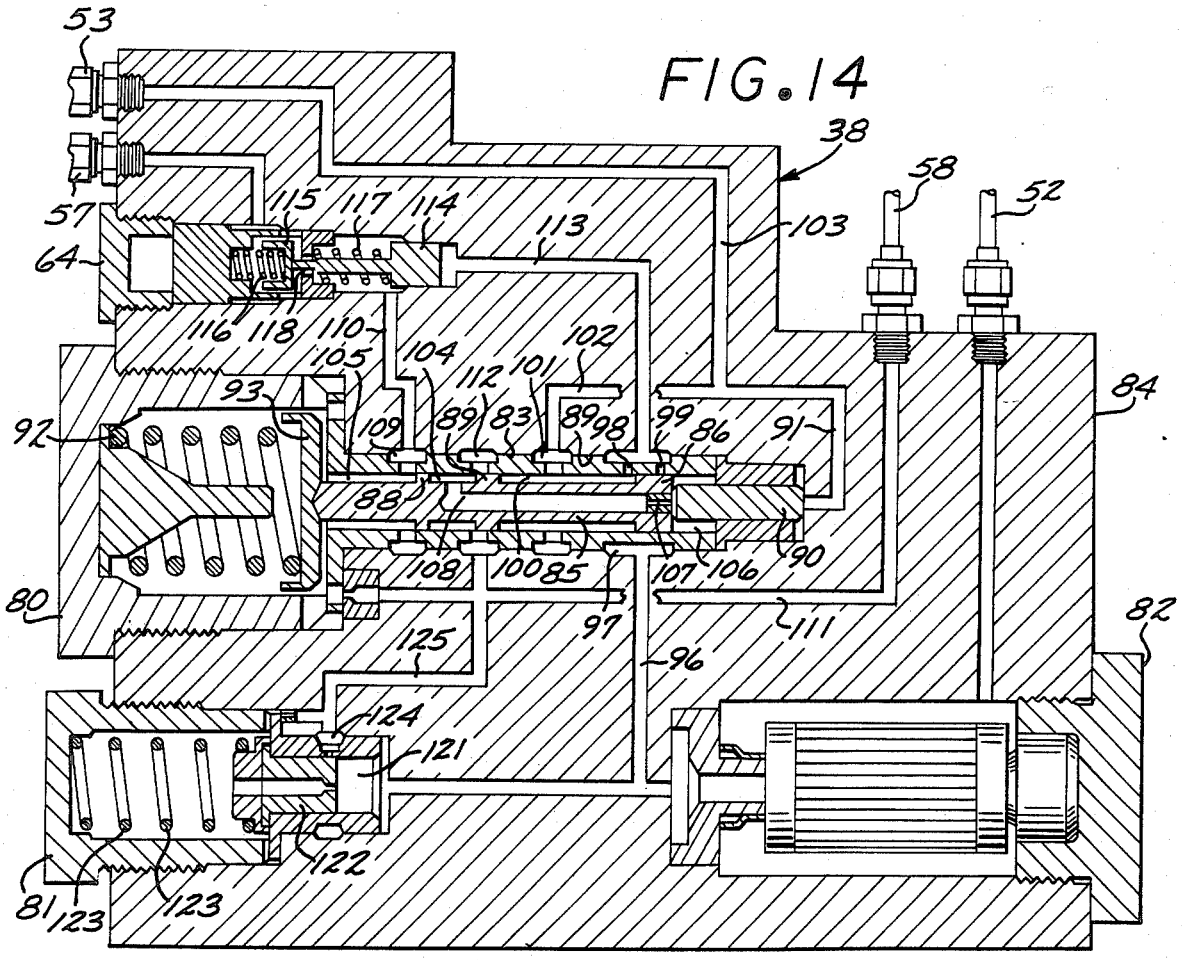
FIG. 14 is a sectional view of the control valve system shown in FIG. 13 illustrating the details thereof.

The operation of the ram drive assembly 32 is best described in conjunction with FIGS. 6 and 13. FIG. 6 shows the extendible portion of ram drive assembly 32 comprising a head section 41 which is fixed to cross member 34 and the interfitting telescoping sections 42, 43, and 44 in an extended position. As shown schematically in FIG. 13, electrical power source to the compactor is turned on by pressing power switch 45. The compactor is started by pushing start switch 47 when the ready light 48 is on. The electrical controls shown generally at 50 activate electrical motor 36 which drives the pump 35. The pump 35 pumps hydraulic fluid from the reservoir 51 through line 52 to the control valve system 38. The high pressure fluid is initially directed from control valve system 38 through line 53 to the head 41 of the ram drive assembly 32. The high pressure fluid fills up inner chambers 54, 55, and 56 thereby causing the telescoping sections to extend in sequence, the first being section 44, the second being section 45, and the last being section 46. In this manner the lightest compacting pressure applied to the trash by ram 33 is applied initially and the highest compacting pressure is applied at the end of the cycle. When the hydraulic pressure acting on the top of section 44 provides a compacting pressure exceeding a predetermined maximum, the control valve system 38 terminates the flow of high pressure fluid through line 53 and puts this line in fluid communication with the discharge line 57 to the reservoir 51 thereby stopping the downward movement of the ram 33. Simultaneously, the control valve system 38 redirects the high pressure fluid flow through line 57 to the outer annular chambers 60, 61, and 62 which are formed in the overlapping portions of the telescopic sections 42–44. The high pressure fluid first causes section 42 to retract, then section 43 and then finally section 44. As the telescopically interfitting sections retract, the hydraulic fluid within the inner chambers 54, 55 and 56 is driven back through line 53 and ultimately to the reservoir 51. When the final section 44 is driven to its retracted or up position (as shown in FIG. 2), the ram 33 actuates the trip switch 63 which shuts off the electrical power to the motor 36 which operates the pump 35, thereby completing the compacting cycle. Preferably, an uplock valve 64 shown in FIG. 14 is provided to hold the retracted ram drive assembly 32 in an up or ready position so that trash can be dropped through the chute 12 into a trash container 30 without interference from the ram 33.

As previously discussed, the very high compacting pressure characteristic of the present invention develops a tenacious frictional engagement between the walls which support the compacting chamber 31 and trash containers 30 disposed therein. Means are provided with the present compactor to effect relative movement between the walls of the chamber 31 and the container 30 to eliminate or reduce the frictional engagement therebetween. FIGS. 2–5 and 8 generally illustrate one embodiment of the invention and FIGS. 9, 10 and 11 illustrate another for effecting relative movement between the walls of the compacting chamber 31 and a trash container filled with compacted trash in order to reduce the frictional adhesion therebetween.

In the embodiment shown in FIGS. 2–5 and 8 one of the side walls 65 of the compacting chamber 31 is provided with hydraulic-actuated pistons 66 located on the outside thereof and suitably fixed to the inside of side panel 23. The hydraulically-actuated pistons 66 are preferably operated so that the pressure applied to the wall 65 increases as the pressure is applied to the inner portion of the wall 65 by the trash container 30 to provide continual support to side 67 of the trash container during the compacting of trash therein. The other side walls 68 and 69 are stationary and likewise provide support to the container during the compaction of trash therein. At the completion of the compacting cycle, the flow of high pressure hydraulic fluid to the pistons is terminated and the fluid therein is released to reservoir 51 to thereby relieve the frictional engagement between the wall 65 of the compacting chamber 31 and the side 67 of the trash container 30. At the completion of the compacting cycle the container full of compacted trash is readily removed from compacting chamber 31 without significant damage to the container 30 and without exerting a considerable manual effort. The container 30 and the compacted trash therein are then discarded. A new trash container 30 may then be inserted into the compacting chamber 31, the door 13 may be closed and the compactor is again ready for further operation.

Figure 9:
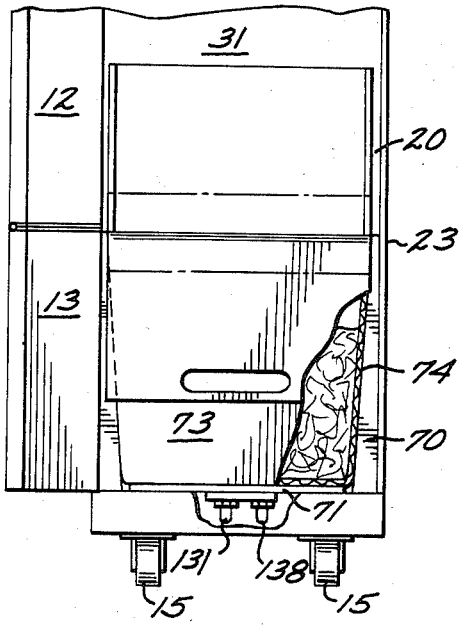
FIG. 9 is a front view of another embodiment of a trash compactor with the door opened, illustrating the position of a trash container within the compactor.
Figure 10:
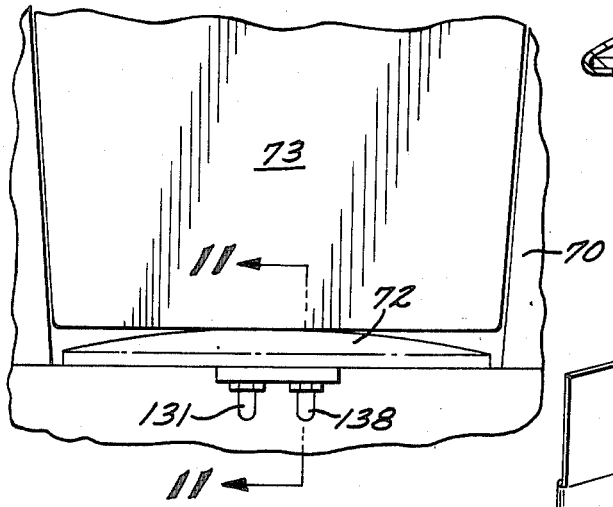
FIGS. 10 and 11 are respectively side and cross-sectional views of an inflatable bladder which is utilized on the floor of the compactor embodiment shown in FIG. 9.
Figure 11:
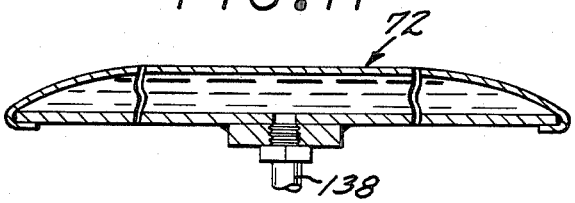

The compactor embodiment shown in FIGS. 9, 10 and 11 is provided with a compacting chamber 31 having walls 70 which taper inwardly in the downward direction toward the floor 71. The floor is provided with or comprises an inflatable bladder or envelope 72 which may be inflated at the end of the compaction cycle to push the trash-filled container 73 upwardly as shown in FIG. 10 in order to relieve the frictional adhesion between the walls 70 of the compacting chamber 31 and the sides 74 of the container 73. In this manner the trash-filled container 73 may then be readily removed through the door 13 without significant damage thereto and without expending a considerable amount of manual effort. As in the previous embodiment, the trash container 73 and the compacted trash therein are subsequently discarded. A new disposable, self-supporting container 73 is then inserted into the chamber 31 and the compactor is ready for further operation.

FIGS. 14 through 18 illustrate the details of the control valve system 38. FIG. 14 shows the basic system in detail and FIGS. 15 and 16 and 17 and 18 show variations in the control valve system 38 directed to the embodiments of the invention shown respectively in FIGS. 4, 5 and 8, and FIGS. 9, 10 and 11.

The basic features of the control valve system 38, best illustrated in detail in FIG. 14, generally comprise a spring-loaded, hydraulically-actuated spool valve 80, an uplock valve 64, a pressure relief valve 81, and a hydraulic filter 82.

The spool valve 80 includes a sleeve 83 disposed within a support block 84, a piston 85 slidably mounted within the sleeve 83 and provided with shoulders 86, 87 and 88 which sealingly and slidably engage the inner surface or bore 89 of the sleeve 83. A drive hammer 90 is provided within the sleeve 83 at one end of the piston 85 which is operated by high pressure hydraulic fluid from line 91. A spring element 92 is biased against spring cap 93 fixed to the other end of the piston to urge the piston 85 toward the hammer 90.

Figure 16:
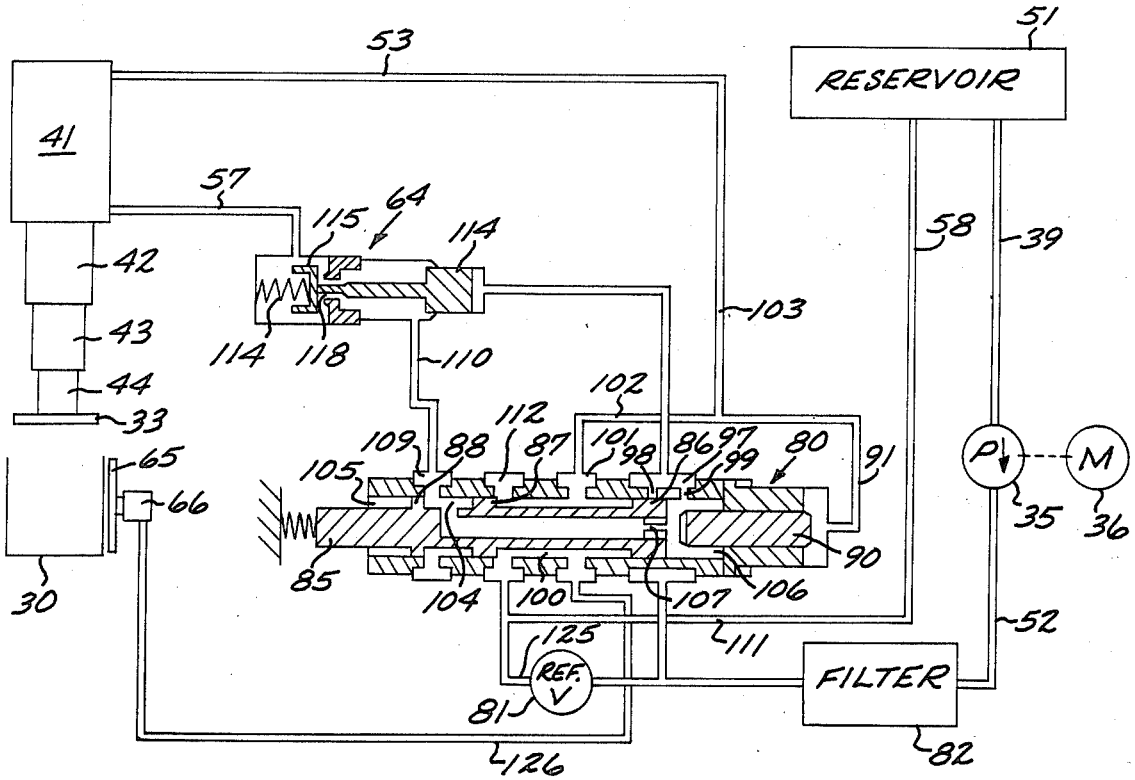
Figure 18:
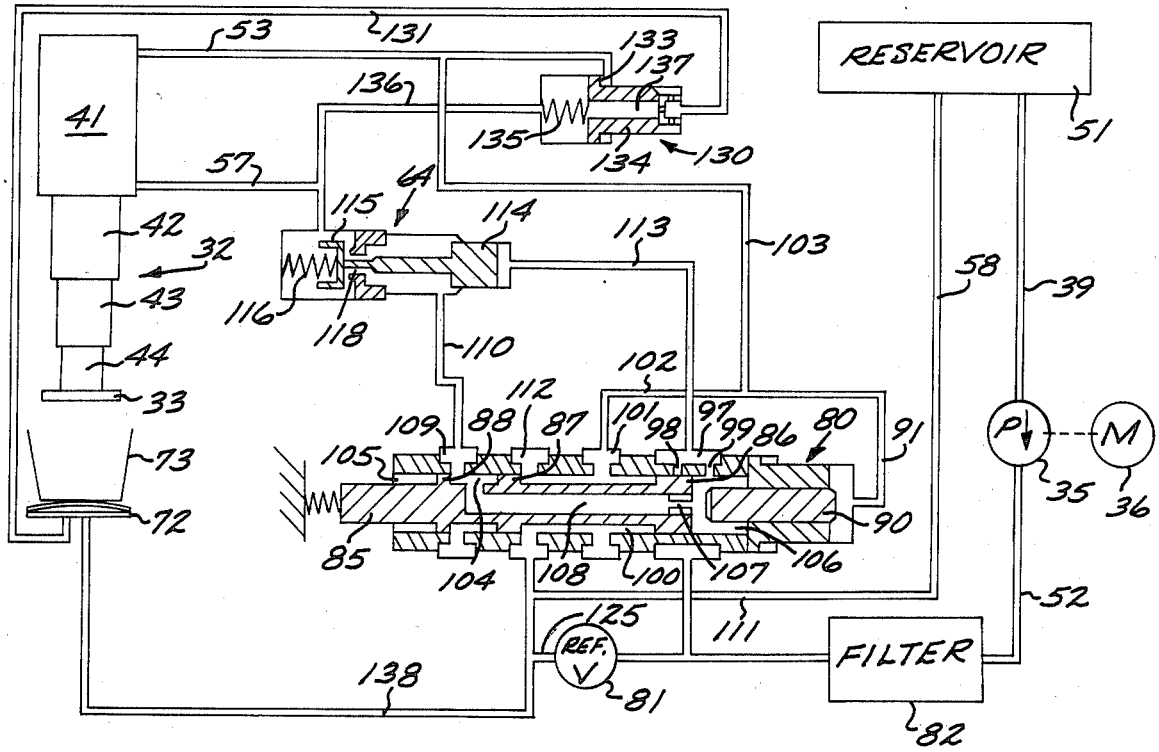

With the position of the piston 85 shown in FIG. 14 the pump 35 (not shown) pumps high pressure hydraulic fluid through lines 39 and 52 to the filter 82 which removes particulate from the fluid and then through line 96 to annular chamber 97 formed by matching channels in the outer surface of the sleeve 83 and the inner surface of the support block 84. Annular chamber 97 is provided with conduits 98 and 99 which pass high pressure hydraulic fluid from the chamber 97 to the bore 89 of sleeve 83. Conduits 98 and 99 are orifices which are sized to control the fluid flow rate with a given pressure drop across the orifice. In this manner the velocity of the extension of the ram drive assembly 32 is controlled by the size of orifice 98 and the velocity of the retraction thereof is controlled by orifice 99. With the piston 85 in the position shown in FIG. 14, shoulder 86 blocks the conduit 99 but conduit 98 is open to the annular passageway 100 which leads high pressure fluid to annular chamber 101 which in turn directs high pressure fluid through line 102 to the hammer 90 by way of line 91 and to ram drive assembly 32 by way of line 103. The hydraulic pressure in lines 91 and 103 builds up as the ram is pressed against the trash in container 30. When the hydraulic pressure in line 103 (and, thus, in line 91 also) provides a compacting pressure exceeding a predetermined maximum limit above 15 psi, preferably above 30 psi, the piston 85 is driven leftwardly by the hammer 90, overcoming the force of the spring 92 against the piston 85. This repositioning of piston 85 realigns the shoulders 86, 87 and 88 and passageways 100, 104 and 105 on the piston with respect to annular chambers 97, 191, 109 and 112 and thereby changes the flow of fluid through the spool valve 80. The movement of piston 85 is generally a two step process. The first step, caused by the hammer 90 pressing against the end of the piston 85, is relatively slow. However, once the shoulder 86 moves to the left a sufficient distance to expose conduit 99, the high pressure fluid acting on the larger area of the end of piston 85 causes the piston 85 to very quickly move to its leftward position. This latter step takes on the order of a few milliseconds. As shown in FIGS. 16 and 18, when the piston 85 is pushed into a leftward position, high pressure hydraulic fluid from annular chamber 97 passes through conduit 99 and fills the cavity 106 at the end of the piston 85 causing the hammer 90 to move away therefrom which in turn allows the high pressure fluid to pass through orifice 107, centrally located passageway 108 in the piston 85, to outer annular chamber 109. Line 110 directs the high pressure fluid from chamber 109 to the uplock valve 64 and ultimately to the hydraulic retraction system of the ram drive assembly 32 through line 57. With the piston 85 in a leftward position as shown in FIGS. 16 and 18, lines 91, 102 and 103 are in fluid communication with return lines 111 and 57 leading to the reservoir 51 through annular passageway 100 and annular chamber 112. Thus, when the high pressure fluid is filling annular chambers 60–62 to retract the ram drive assembly 32, the hydraulic fluid in internal chambers 54–56 is forced out of these chambers through the aforesaid intercommunicating system to the reservoir 51.

When the ram drive assembly 32 is completely retracted and the ram 33 activates the trip switch 63, which turns off the motor 36 driving the pump 35 and all high pressure fluid flow terminates. With the fluid chamber 106 no longer exerting a high pressure, the spring 92 urges the piston 85 back to its original or ready position and the entire control valve system 38 is ready for another compacting cycle.

With respect to the uplock valve 64, high pressure line 113 causes the spring-actuated hammer 114 to hold the sealing element 115 of the valve 64 against the spring 116, thereby maintaining the valve 64 open for the passage of both high pressure fluid to the retracting system of the ram drive assembly 63 and for the passage of the low pressure fluid away from the ram drive assembly 32 to the reservoir 51. Only when the pump operation is terminated i.e., when the ram 33 trips the switch 63 when drawn into the up position, does the pressure in line 113 fall to a level which allows the spring 116 acting on sealing cap 115 and spring 117 acting on the hammer 114 to urge the hammer 114 to move rightwardly and thereby allow sealing cap 115 to close the aperture 118. This closes the uplock valve 64 with pressurized fluid left in the cavities 60–62 of the extendible ram drive assembly 32 so that the ram 33 is held in the up position until another compaction cycle is initiated.

The relief valve 81 operates in a conventional manner. The high pressure line 120 from the filter 82 directs the high pressure hydraulic fluid to the chamber 121 of the relief valve 81. When the pressure of the fluid in chamber 121 acting against piston 122 exceeds a predetermined maximum level as determined by the force of the spring 123 against the piston 122, the piston 122 is moved to the left thereby completing the fluid communication between the chamber 121 containing high pressure fluid and the annular chamber 124 and the discharge line 125 which leads the high pressure hydraulic fluid to the reservoir 51 through lines 111 and 57. When the pressure in chamber 121 falls below the predetermined maximum, the spring 123 then urges the piston 122 rightwardly into chamber 121 to again block the flow of fluid to chamber 121.

Figure 4:
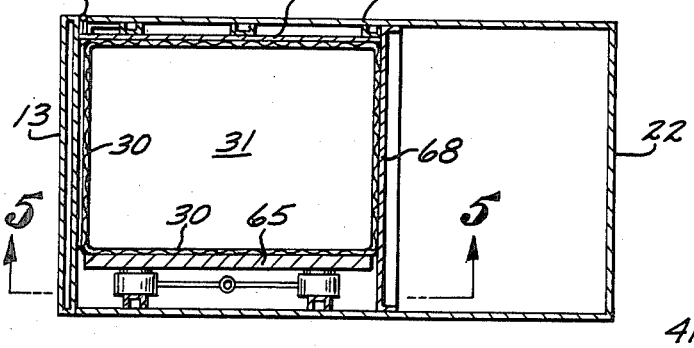
FIG. 4 is a transverse sectional view taken along the lines of 4—4 shown in FIG. 2.
Figure 5:
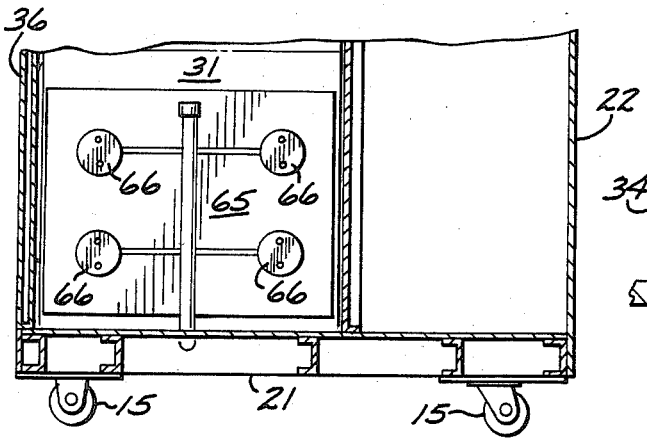
FIG. 5 is a partial vertical view in section taken along the lines of 5—5 in FIG. 4.
Figure 8:
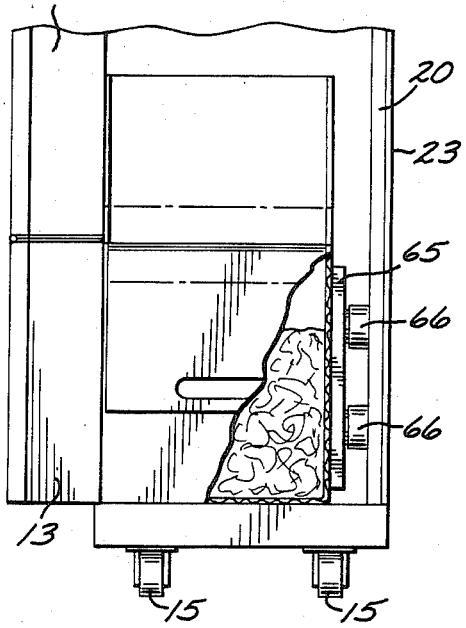
FIG. 8 is a front view of a trash compactor with the front door in an opened position illustrating a trash container within the compactor shown in FIGS. 4 and 5.
Figure 15:
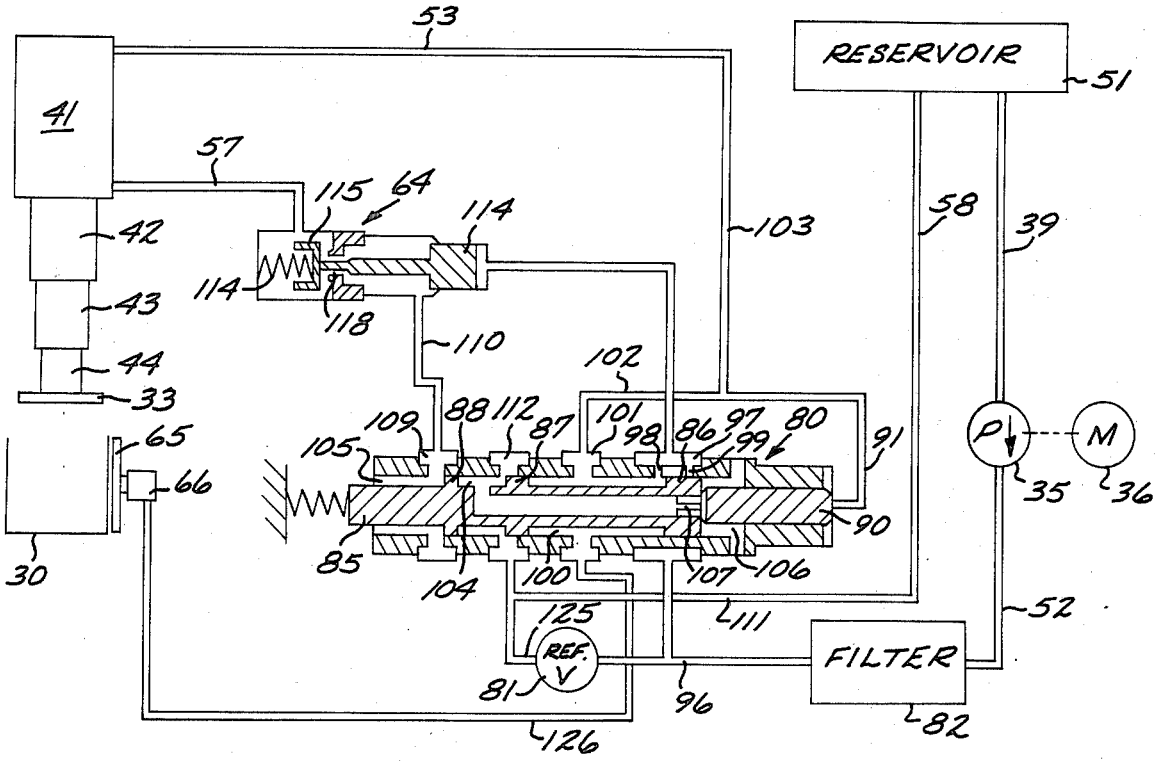
FIGS. 15 and 16 are schematic views of hydraulic power and control systems suitable for the embodiment shown in FIGS. 2–5.

FIGS. 15 and 16 illustrate a modification to the spool valve 80 and other parts of the control valve system 38 for the embodiment shown in FIGS. 4, 5 and 8 which includes a line 126 leading from annular cavity 101 in the spool valve 80 to a plurality of hydraulically-actuated pistons 66 (only one shown in FIGS. 15 and 16) which move wall 65 to release the frictional engagement between the wall 65 and a trash container 30 filled with compacted trash. The spool valve 38 and other components of control valve system 38 operate in essence as previously described. When high pressure fluid flows into annular chamber 101 to extend the ram drive assembly 32, line 126 in communication therewith directs high pressure fluid to the pistons 66 which urge the wall 65 against the trash container 30 while the ram 33 is compacting trash therein. Upon the movement of the piston 80 to the leftward position when the hydraulic pressure exceeds the level which provides a compacting pressure above a predetermined limit, the flow of high pressure fluid to pistons 66 is terminated and line 126 is placed in fluid communication with return line 111 to reservoir 51.

Figure 17:
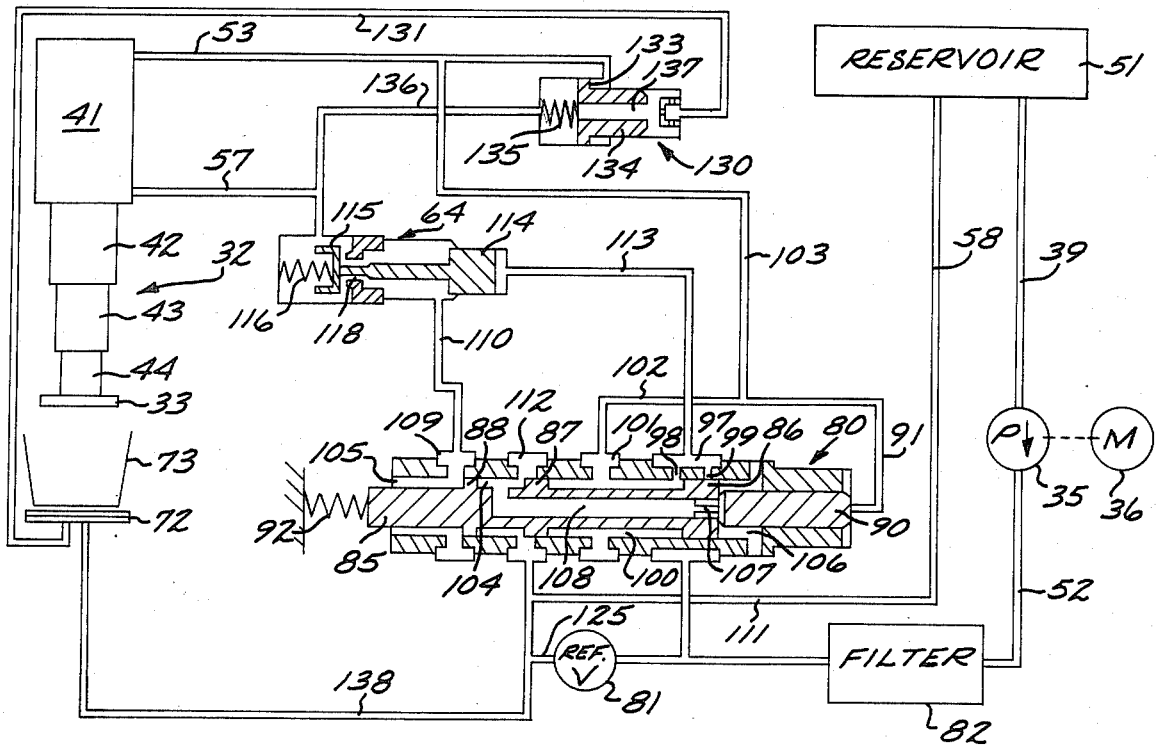
FIGS. 17 and 18 are schematic views of hydraulic power and control systems for the embodiment shown in FIGS. 9–11.

FIGS. 17 and 18 represent the control valve system 38 for the compactor embodiment shown in FIGS. 9, 10 and 11. For the most part, the control valve system 38 follows that shown in FIGS. 15 and 16, except that a check valve 130 is provided to direct high pressure fluid through line 131 to inflate the bladder 72 when the flow of high pressure fluid to the head section 41 of the ram drive assembly 32 is terminated. The inflated bladder 72 as shown in FIGS. 18 and 11 urges the trash container 73 filled with compacted trash upwardly to disengage the cardboard box from the tapered walls 70 of compacting chamber 31 and thereby facilitate the ready removal of the trash container 73 from the chamber 31.

The check valve 130 operates by balancing the pressure of the high pressure fluid from line 131 on the shoulder 133 of piston 134 against the force applied to the piston 134 by the spring 138. Upon completion of the downward stroke of the ram drive assembly 32, the pressure in line 53 is reduced substantially and the pressure in line 136 from the uplock valve 64 increases substantially so that piston 134 is driven rightwardly by spring 135. High pressure fluid from line 136 is directed through longitudinal passageway 137 of piston 134 and on through line 131 to inflate the bladder 72. When the ram 33 is retracted into the up position and thereby actuates trip switch 63, the high pressure fluid no longer flows through line 136 and the bladder 132, which is formed of two pieces of sheet metal soldered around the edges thereof, naturally contracts to squeeze the fluid therein through line 138 to the reservoir 51.

The trash containers particularly suitable for compactors in accordance with the present invention are the trash containers described and claimed in copending application, Ser. No. 635,141 which is assigned to the present assignee and are shown herein in FIGS. 7 and 12. One of the main advantages of these containers is the fact that they can be stored in a folded condition and, when needed for use, merely opened up and placed within the compacting chamber of the compactor. Preferably, the containers are of the cardboard or paperboard type products and they would be lined so that they do not absorb liquids which frequently accompany the trash. Suitable plastic containers may also be used.

Figure 7:
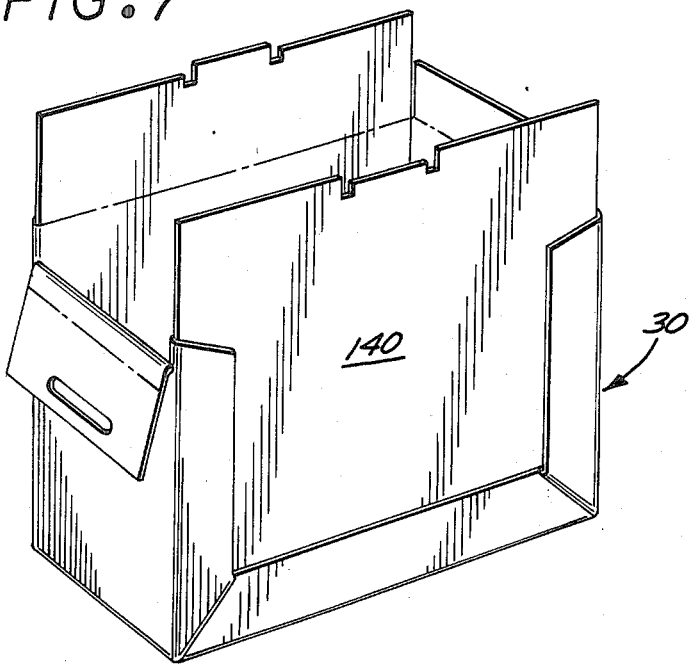
FIG. 7 is a disposable, self-supporting trash container which is suitable for use in the embodiment shown in FIGS. 2–5.
Figure 12:
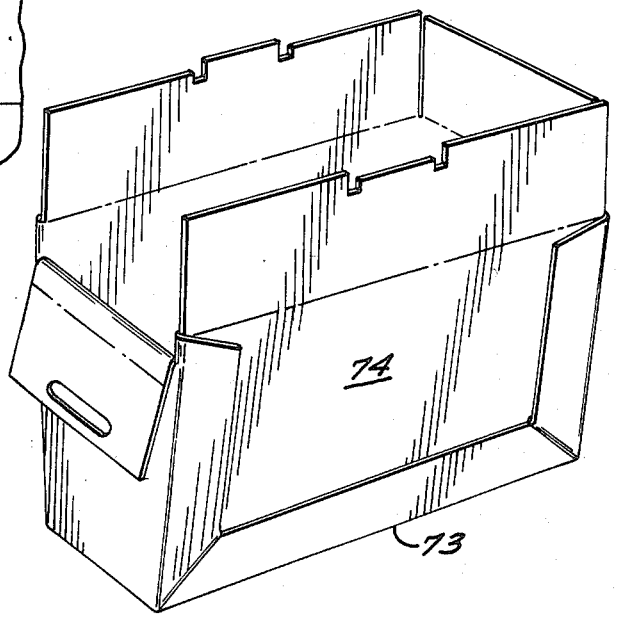
FIG. 12 is a perspective view of a disposable, self-supporting trash container suitable for use with the embodiment shown in FIG. 9.

The container 30 shown in FIG. 7 is provided with straight side walls 140 to match the straight walls of the compacting chamber 31 of the compactor embodiment shown in FIGS. 4, 5 and 8, whereas the container 73 shown in FIG. 12 is provided with tapered side walls 74 which match the tapered walls 70 of the compacting chamber 31 of the compactor embodiment shown in FIGS. 9, 10 and 11. When these containers (both 30 and 73) are filled with compacted trash, they are readily removed from the compactor with little or no effort and without damage thereto by following the teachings of the present invention.

A motor suitable for providing the compacting pressures in accordance with the invention is a three phase, 1.5 H.P. electrical motor which operates with a current frequency of 400 hertz. Average compaction cycles are about 30 seconds and the compaction ratios (original trash volume to compacted volume) provided are typically about 10:1. The maximum weight of the trash containers (12"×16"×15") filled with compacted trash of the type generated on board aircraft usually does not exceed 40 pounds so these filled containers can be readily handled by in-flight service personnel.

It is obvious that various modifications and improvements can be made to the present invention without departing from the scope thereof. For example, although the description of the present invention provided herein has been in terms of a compactor having a single chamber for compacting, it is obvious that a compactor can be provided with a compacting chamber and a storing chamber as described in the aforementioned copending application Ser. No. 635,141. In that case, a removable back wall would have to be provided in the compacting chamber so that, upon completion of the compaction, the back wall can be removed and the filled trash container pushed to the storage chamber provided in back of the compacting chamber. The removable back wall would then be replaced into position, a new trash container placed within the compacting chamber and the compactor would be ready for operation. Other modifications are also possible.

What is claimed is:

1. A trash compactor, comprising:

a. a housing having a support frame;

b. a trash compacting chamber within said housing adapted to receive a disposable, self supporting trash container having walls and a bottom and provided with containment walls and flooring which support the walls and bottom of disposable, self-supporting trash container disposed therein;

c. loading means to direct trash into disposable, self-supporting trash containers disposed within the compacting chamber;

d. extendible ram drive means disposed within the interior of said housing and supported at one end thereof by the support frame in an upper portion of the housing and having a compacting ram at the other end thereof;

e. power means to extend the ram drive means to drive the compacting ram into a disposable, self-supporting trash container disposed within the compacting chamber to compact trash therein;

f. power means to retract the ram drive means;

g. power control means to terminate the extension of the ram drive means and to retract the ram drive means when the compacting pressure applied by the ram to trash therein exceeds a predetermined pressure; and h. displacement means which is actuated upon the retraction of the ram drive means to effect relative movement between a trash container disposed within the compacting chamber and one of the containment walls or the flooring of the compacting chamber to thereby loosen the frictional engagement which builds up therebetween from the compaction of trash therein so that the trash container can be readily removed from the compacting chamber.

2. The trash compactor of claim 1, wherein the power means are operated by high pressure hydraulic fluid.

3. The trash compactor of claim 2, including means to sense the hydraulic pressure in the hydraulic power means to extend the ram drive means and means responsive to the hydraulic pressure sensing means to terminate the extension of the ram drive means and retract same when the predetermined compacting pressure is at least 15 psi.

4. The trash compactor of claim 3 designed for aircraft or aerospace use wherein the ratio of the maximum force applied by the compacting ram to the tare weight of the compactor exceeds 40 to 1.

5. The trash compactor of claim 2, wherein the displacement means comprises an inflatable bladder to effect relative movement.

6. The trash compactor of claim 2, wherein the displacement means include at least one hydraulic pistons actuated by the hydraulic power means acting on a movable containment wall of the compacting chamber.

7. The trash compactor of claim 6, wherein the one or more hydraulic pistons press the movable containment wall against a side of the trash container as the compacting ram compacts trash in the trash container.

8. The compactor of claim 7, including means to release the hydraulic pressure on the pistons to thereby effect the relative movement.

9. The trash compactor of claim 2, wherein the hydraulic power control means includes a four-way spool valve having a sleeve with a central bore, a piston disposed within said bore having a plurality of shoulders which slidably and sealingly engage the surface of the bore, means to adjust the position of the piston within the bore when the compacting pressure exceeds a predetermined maximum pressure to align conduits and cavities associated with the piston and sleeve and to thereby control the flow of hydraulic fluid therethrough.

10. The compactor of the claim 9, wherein the means to move the piston within the bore comprises a biasing means urged against one end of the piston at one end of the bore and a hammer means at the other end of the bore, said hammer means driven by hydraulic fluid from the hydraulic power means and when the hydraulic pressure applied to the hammer exceeds the hydraulic pressure which provides a predetermined maximum compacting pressure, the hammer will overcome the biasing force applied to the piston by the biasing means and move the piston within the sleeve, thereby realigning the conduits and cavities of the sleeve and piston to change the flow of hydraulic fluid therethrough.

11. The trash compactor of claim 1, wherein a door is provided in the housing to facilitate insertion and removal of a trash container from the compacting chamber.

12. The trash compactor of claim 1, wherein the containment walls of the compacting chamber taper inwardly toward the flooring of the chamber.

13. The trash compactor of claim 1, wherein a trash loading chute is provided in the housing for directing trash into the compacting chamber.

14. The trash compactor of claim 1, wherein hydraulic means are provided to hold the ram drive means in an up position above trash containers disposed in the compacting chamber.

15. The trash compactor of claim 1, wherein the ram drive assembly comprises a plurality of telescopically interfitting sections.

16. The compactor of claim 1, wherein the power control means includes means to control the extension and retraction velocity of the ram drive means.

17. An aircraft or space vehicle trash compactor, comprising:

a. a housing having a support frame;

b. a trash compacting chamber within said housing adapted to receive a disposable, self-supporting trash container and provided with containment walls and flooring which support the walls and bottom of disposable, self-supporting trash containers disposed therein;

c. loading means to direct trash into disposable, self-supporting trash containers disposed with the compacting chamber;

d. extendible ram drive means disposed within the interior of said housing and supported at one end thereof by the support frame in an upper portion of the housing and having a compacting ram at the other end thereof, the extendible portion thereof comprising a hollow head section secured to the support frame and at least two telescopically interfitting sections;

e. hydraulic power means to extend the ram drive means to drive the compacting ram into a disposable, self-supporting trash container within the chamber to thereby compact trash therein;

f. hydraulic power means to retract the ram drive means;

g. means to sense the hydraulic pressure in the hydraulic power means to extend the ram drive means;

h. hydraulic power control means responsive to the hydraulic pressure sensing means to terminate the extension of the ram drive means and to retract the ram drive means when the compacting pressure applied by the ram to trash therein exceeds a predetermined maximum pressure greater than 15 psi.

18. The trash compactor of claim 17, wherein the predetermined maximum pressure exceeds 30 psi.

19. A spool valve system for controlling the flow of high pressure fluid from a source thereof to at least two separate locations and the flow of fluid from the two separate locations to a receptacle therefor comprising:

a. an elongated sleeve having a cylindrical wall and a longitudinal open ended bore therein;

b. an elongated piston disposed within the bore having a plurality of shoulders which slidably and sealingly engage the bore of the sleeve, the outer surface of the piston between two of the shoulders in conjunction with the inner surface of the cylindrical wall defining an annular passageway;

c. first conduit means in fluid communication with the high pressure fluid source and the bore of the sleeve and passing through the wall of the sleeve;

d. second conduit means in fluid communication with the receptacle and the bore of the sleeve and passing through the wall of the sleeve;

e. third conduit means in fluid communication with a first location and the bore of the sleeve and passing through the wall of the sleeve;

f. fourth conduit means in fluid communication with a second location and the bore of the sleeve and passing through the wall of the sleeve;

g. biasing means acting on one end of the piston to urge the piston to a first position within the bore of the sleeve, whereby the first conduit means in communication with the high pressure source is brought into fluid communication with the third conduit means through said annular passageway to direct high pressure fluid to the first location and whereby the second conduit means in fluid communication with the receptacle is brought into fluid communication with the second location to direct fluid from the second location to the receptacle;

h. hammer means within the bore of the sleeve adjacent to the other end of the piston; and i. means responsive to the fluid pressure in one of the conduits in fluid communication with one of the locations to drive the hammer against the adjacent end of the piston to urge the piston against the biasing means to a second position within the bore of the sleeve when the fluid pressure exceeds a predetermined limit, whereby the first conduit means in fluid communication with the high pressure fluid source is brought into fluid communication with the fourth conduit means to direct high pressure fluid to the second location and whereby the second conduit means is brought into fluid communication with the third conduit means to direct fluid from the first location to the receptacle.

* * * * *